US012416449B2

(12) United States Patent
Runk et al.

(10) Patent No.: US 12,416,449 B2
(45) Date of Patent: Sep. 16, 2025

(54) FOLDED COIL TUBE SPACER

(71) Applicant: MAHLE International GmbH, Stuttgart (DE)

(72) Inventors: Robert Louis Runk, Lockport, NY (US); Scott Kent, Albion, NY (US); Ryan Rowan, Newfane, NY (US)

(73) Assignee: MAHLE International GmbH, Stuttgart (DE)

( * ) Notice: Subject to any disclaimer, the term of this patent is extended or adjusted under 35 U.S.C. 154(b) by 475 days.

(21) Appl. No.: 17/529,358

(22) Filed: Nov. 18, 2021

(65) Prior Publication Data

US 2023/0152041 A1 May 18, 2023

(51) Int. Cl.

| | |
|---|---|
| ***F28D 1/053*** | (2006.01) |
| ***F28F 1/02*** | (2006.01) |
| ***F28F 9/00*** | (2006.01) |
| ***F28F 9/013*** | (2006.01) |

(Continued)

(52) U.S. Cl.

CPC ..... *F28D 1/05366* (2013.01); *F28F 1/022* (2013.01); *F28F 9/001* (2013.01); *F28F 9/0131* (2013.01); *F28F 9/0273* (2013.01); *F28F 17/005* (2013.01); *F28F 2240/00* (2013.01)

(58) Field of Classification Search

CPC .... F28D 1/0475; F28D 1/0476; F28D 1/0535; F28D 1/053; F28F 9/013; F28F 9/0131; F28F 9/0132; F28F 13/0182; F28F 2240/00; F28F 1/02; F28F 2265/30; F28F 17/005; F16L 3/1033

See application file for complete search history.

(56) References Cited

U.S. PATENT DOCUMENTS 5,531,268 A 7/1996 Hoshino et al.
9,702,587 B2 * 7/2017 Kita ..... F28D 1/0472

(Continued)

FOREIGN PATENT DOCUMENTS

CN 203518352 U 4/2014
CN 104110977 A 10/2014

(Continued)

OTHER PUBLICATIONS

Reynolds Smooth-Sil® 960 Silicone Rubber Compounds, MatWeb Material Property Data, 2 pages (Year: 2024).*

*Primary Examiner* — Jianying C Atkisson
*Assistant Examiner* — For K Ling
(74) *Attorney, Agent, or Firm* — Dickinson Wright PLLC

(57) ABSTRACT

A spacer device for incorporation into a bent-tube heat exchanger that includes a spine and a plurality of fingers that protrude from one side of the spine. The number of fingers in the spacer device is less than the number of tubes that are folded in a region to form the bent-tube heat exchanger. The plurality of fingers are configured to exert a force against the tubes and to provide and maintain a separation between the tubes in the folded region. A heat exchanger that includes the spacer device may also include a coating on the tubes in the folded region in order to reduce corrosion and increase the life-time of the heat exchanger. The method of forming the heat exchanger includes placing the spacer device between the tubes, such that the fingers lay on the tubes in the region to be folded and assist in the folding process.

13 Claims, 4 Drawing Sheets

(51) Int. Cl.
*F28F 9/02* (2006.01)
*F28F 17/00* (2006.01)

(56) References Cited

U.S. PATENT DOCUMENTS

| | | | | |
|---|---|---|---|---|
| 2001/0040021 | A1* | 11/2001 | Avequin | F28D 1/0435 29/890.03 |
| 2009/0014151 | A1* | 1/2009 | Capelle | F28F 1/06 165/44 |
| 2012/0267088 | A1* | 10/2012 | Lange | F28F 9/0131 165/181 |
| 2013/0034743 | A1* | 2/2013 | Bannai | C09D 5/14 427/299 |
| 2015/0247677 | A1* | 9/2015 | Cochran | F28D 1/05366 165/181 |
| 2016/0010905 | A1* | 1/2016 | Wang | F28D 1/0476 62/190 |
| 2017/0343288 | A1 | 11/2017 | Joardar | |
| 2020/0263937 | A1* | 8/2020 | Challa | F16L 3/10 |

FOREIGN PATENT DOCUMENTS

| | | | | |
|---|---|---|---|---|
| DE | 102015100227 | A1 * | 8/2015 | F16L 3/222 |
| EP | 2884209 | A1 | 6/2015 | |
| EP | 3561430 | A2 * | 10/2019 | F24F 13/22 |
| WO | WO-2020081389 | A1 * | 4/2020 | F28D 1/0476 |

* cited by examiner

FOLDED COIL TUBE SPACER

FIELD

This disclosure relates generally to heat exchangers or evaporators. More specifically, this disclosure relates to heat exchangers that include bent tubes in a coil-like configuration.

BACKGROUND

The statements in this section merely provide background information related to the present disclosure and may not constitute prior art.

Heat exchangers 1, such as the one shown in FIGS. 1A and 1B, which incorporate a bent tube structure 5, are becoming more popular than conventional plate and fin heat exchangers due to their compactness, low weight, structural rigidity, and enhanced performance characteristics. These heat exchangers 1 are also more environmentally friendly due to the smaller amount of refrigerant that needs to be circulated through their bent tubes 5. Generally, the bent tubes 5 exhibit a flattened cross-section 10 along with multiple parallel flow channels (→). A plurality of fins 15 extend between the tubes 5 in order to enhance efficiency with respect to thermal energy exchange between the refrigerant and the surrounding environment. Each of the tubes 5 is in fluid communication with one or more manifolds 13 having an inlet 17 or an outlet 21.

When tubes 5 are folded in half to create a multiple row coil-like configuration 20, the tubes 5 in the folded region, which have no centers between them, will be in direct contact 25. Tubes 5 that are in constant contact with each other can lead to continual rubbing and overtime result in the formation of leaks. For coil-like configurations 20 where the folded region is located at the bottom of the heat exchanger, the contact made by the tubes may also allow water to gather with limited ability for proper drainage. This accumulation of water may cause the acceleration of corrosion processes, thereby weakening the structural integrity of the tubes 5. Thus, when tubes 5 are allowed to remain in direct contact 25 with each other, the coils are predestined to prematurely fail.

SUMMARY

The present disclosure generally provides a spacer device for incorporation into a bent-tube heat exchanger. This spacer device comprises a spine and a plurality of fingers that protrude from one side of the spine. The number of fingers in the spacer device is less than the number of tubes that are folded in a region to form the bent-tube heat exchanger. The plurality of fingers are configured to exert a force against the tubes and to provide and maintain a separation between the tubes in the folded region.

According to another aspect of the present disclosure, a bent-tube heat exchanger is provided. This heat exchanger comprises a plurality of tubes folded in a region to form a coil-like configuration having a flattened cross-section along with multiple parallel flow channels. This heat exchanger includes a plurality of fins that extend between the tubes. In addition, the heat exchanger includes one or more manifolds that form an inlet and outlet for fluid flow within the heat exchanger. Each of the plurality of tubes in the heat exchanger is in fluid communication with the one or more manifolds. The heat exchanger further includes a spacer device comprising a spine and a plurality of fingers that provides and maintains a separation between the tubes in the folded region.

According to yet another aspect of the present disclosure, a method for providing and maintaining separation between tubes during the formation of a bent-tube heat exchanger is provided. This method generally comprises the steps of providing a spacer device having a thickness (T); providing a plurality of tubes; placing the spacer device, such that each finger in the spacer device is located between two of the tubes; and folding the tubes in a region to form a coil-like configuration, such that the spacer device remains between the tubes in the folded region. Optionally, the method may further include maneuvering the spacer device into place and/or holding the spacer device in place during the folding of the tubes through the use of at least one hole formed in the spine of the spacer device. The method may further include covering one or more of the tubes in the region to be folded with a protective coating that either provides a physical barrier between the tubes and the oxidizing elements in the environment or is a sacrificial material that preferentially corrodes before the tubes.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way. It should be understood that throughout the description, corresponding reference numerals indicate like or corresponding parts and features.

DETAILED DESCRIPTION

The following description is merely exemplary in nature and is in no way intended to limit the present disclosure or its application or uses. For example, the device made and used according to the teachings contained herein are described throughout the present disclosure in conjunction with a bent tube or coiled heat exchanger used in an air conditioner system in order to more fully illustrate the construction and the use thereof. The incorporation and use of such a device in other heating, ventilation, air conditioning, and refrigeration applications wherein a bent tube or coiled heat exchanger would be desirable is contemplated not to exceed the scope of the present disclosure.

The present disclosure generally provides a device configured as a spacer that provides separation between the bent tubes or coil during the production and operation of a heat exchanger. During the production of a heat exchanger, the spacer device is inserted in between the tubes before folding, in order to keep the tubes from touching during and after folding. This spacer device remains in contact with the tubes or coil-like configuration during the operation of the heat exchanger in order to maintain the spacing and to assist in guiding the drainage of condensate. Since the spacer device keeps the tubes of the folded core from coming in direct contact with one another, the reduction in frictional rubbing during production and operation will extend the life-time associated with the coil.

The spacer device may be formed of any soft plastic or hard rubber material. Such materials may include, without limitation, polyurethanes, thermoplastic elastomers (TPEs), polyolefins, epoxies, fluoropolymers, silicones, polyamide, polycarbonate, polyesters, polyethylene, polyvinyl chloride, natural rubber (NR), styrene-butadiene rubber (SBR), ethylene propylene diene monomer rubber. (EPDM), nitrile butadiene rubber (NBR) and/or mixtures and combinations thereof. Alternatively, the spacer device is comprised substantially of one type of soft plastic or hard rubber material. The hardness of the material generally ranges from about 5 to about 85 (Shore A durometer) or less than 45 (Shore D durometer). The measurement of Shore hardness may be performed according to ASTM D2240, ISO 868, or ISO 7619-1:2010 standard test methods.

Figure 1B:
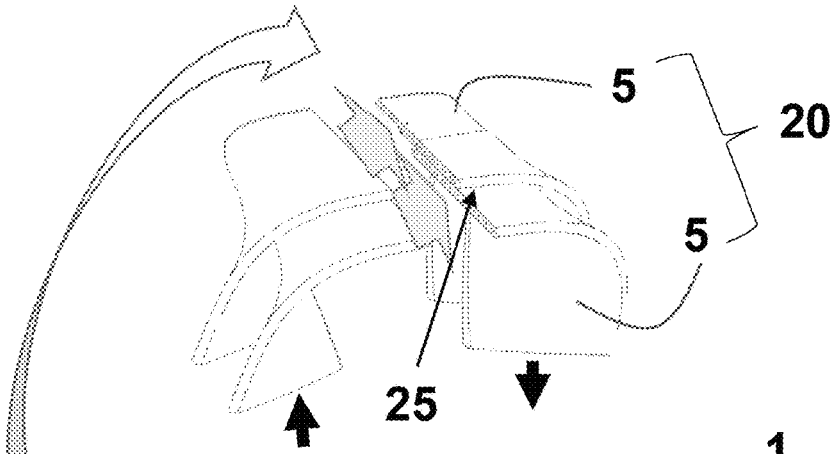
Figure 1B (Prior Art)
FIG. 1B is an enlarged schematic representation of the bent sections of two tubes in the heat exchanger of FIG. 1A.
Figure 1A:
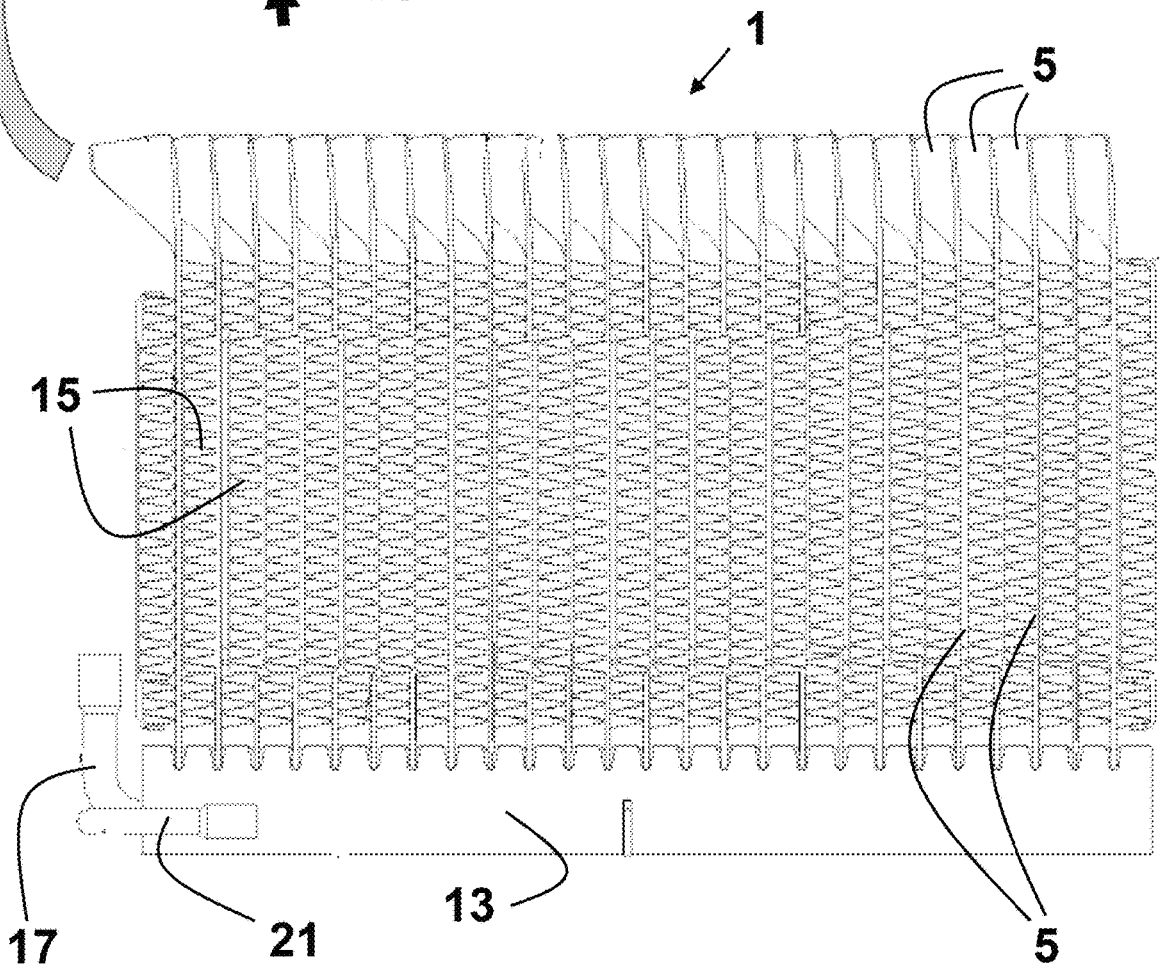
Figure 1A (Prior Art)
FIG. 1A is a schematic representation of a conventional bent tube or coiled heat exchanger shown from a side view perspective.
Figure 2:
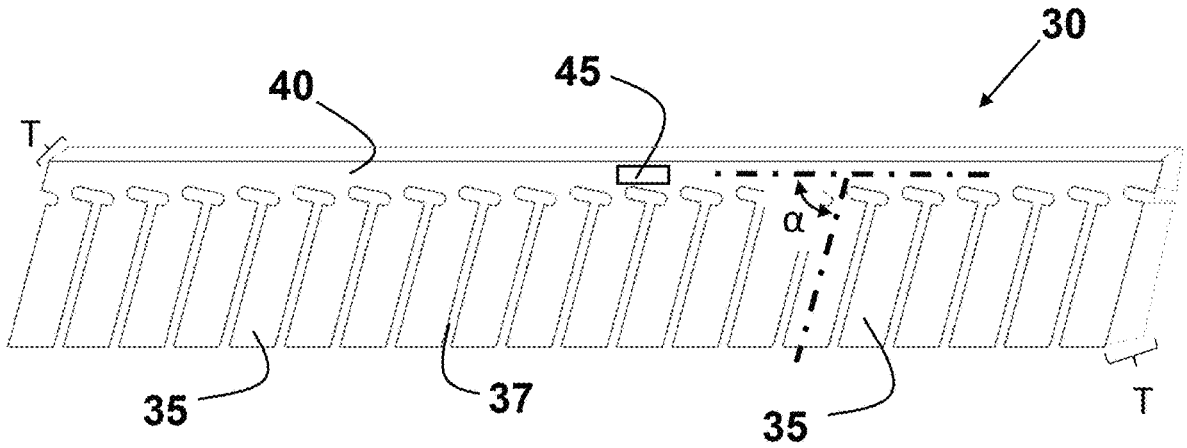
FIG. 2 is a schematic representation of a device constructed according to the teachings of the present disclosure that is configured to keep the bent tubes in the heat exchanger of FIG. 1 separated.
Figure 3:
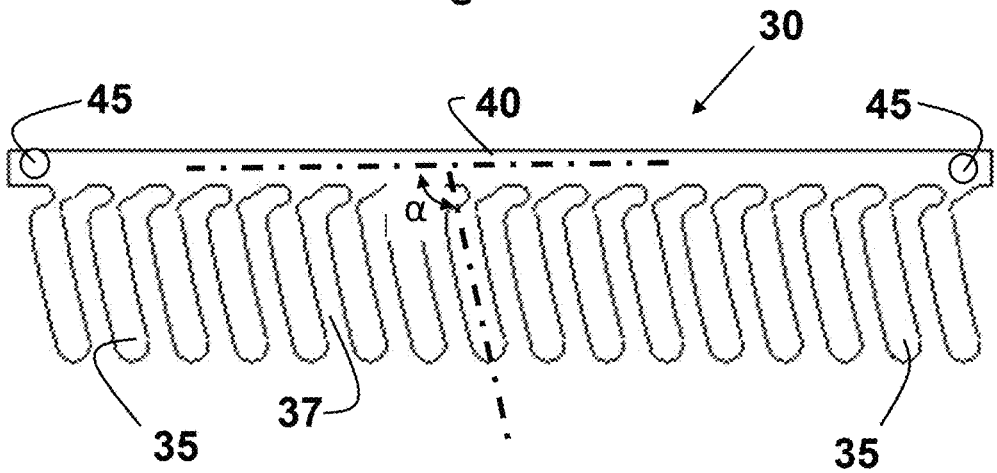
FIG. 3 is a schematic representation of another device constructed according to the teachings of the present disclosure that is configured to keep the bent tubes in the heat exchanger of FIG. 1 separated.

There are many different design configurations that could be used as the spacer device with variations in the thickness of the material, the length of the protruding fingers, and the angle at which the fingers protrude from the device being predetermined as necessary to optimize performance for heat exchangers used in different applications. Two of the possible design configurations are shown in FIGS. 2 and 3. The design configuration of the spacer device 30 generally includes a plurality of fingers 35 that protrude from one side of a backbone or spine 40, such that each finger 35 may be placed in between the tubes before the initiation of the folding process. The number of fingers 35 in the spacer device 30 may be any number that is less than the number of folds that are to be made in the tubes used to form the bent-tube heat exchanger. Alternatively, the number of fingers 35 is one less than the number folds, such that the fingers provide separation between each of the tubes during and after the folding process.

Still referring to FIGS. 2 and 3, when desirable, the fingers 35 may be configured, such that they exert a force against the tubes in a certain direction. This spacer device 30 may be inserted between the tubes before the pre-bend process in order to aid in the folding or bending of the tubes. Each of fingers 35 in the spacer device 30 are separated by a slot 37 in which the tube may be at least partially placed. When desirable, the fingers 35 may also be curved into a pre-determined shape providing an angle ($\alpha$) with respect to the spine 40 that is configured to be compatible with and assist in the folding process of the tubes. The angle ($\alpha$) may be obtuse or acute depending upon the direction of the bend desired for the tubes. The shape of the slot may include a L-shape (FIG. 3) or a T-shape (FIG. 2) that can further assist in the placement of and/or the folding of the tubes.

One or more holes 45 may be added to the spacer device 30 so that it may be maneuvered into place and held therein until after the folding process is completed. The holes 45 may be any desired shape, including but not limited to, circular, elliptical, triangular, square, and/or rectangular. The one or more holes are generally placed within the spine 40 of the spacer device 30.

The spacer device 30 fits snugly between the bent or folded tubes 5 during and after the folding process. During the folding process the fingers 35 will turn to lay on the tubes 5 and provide the correct spacing between tubes 5. The thickness (T) of the material used to form the spacer device 30 represents the spacing or separation that is provided by the fingers 35 of the device 30 between tubes 5. The thickness (T) of the material of the spacer device 30 is best shown in FIG. 2. For coils 20 with the fold at the bottom, the fingers 35 left in the coil-like configuration 20 will help guide condensate out of the center of the coil-like configuration 20, thereby, assisting in the drainage of the condensate from the folded region of the tubes that form the bent-tube heat exchanger.

Figure 4:
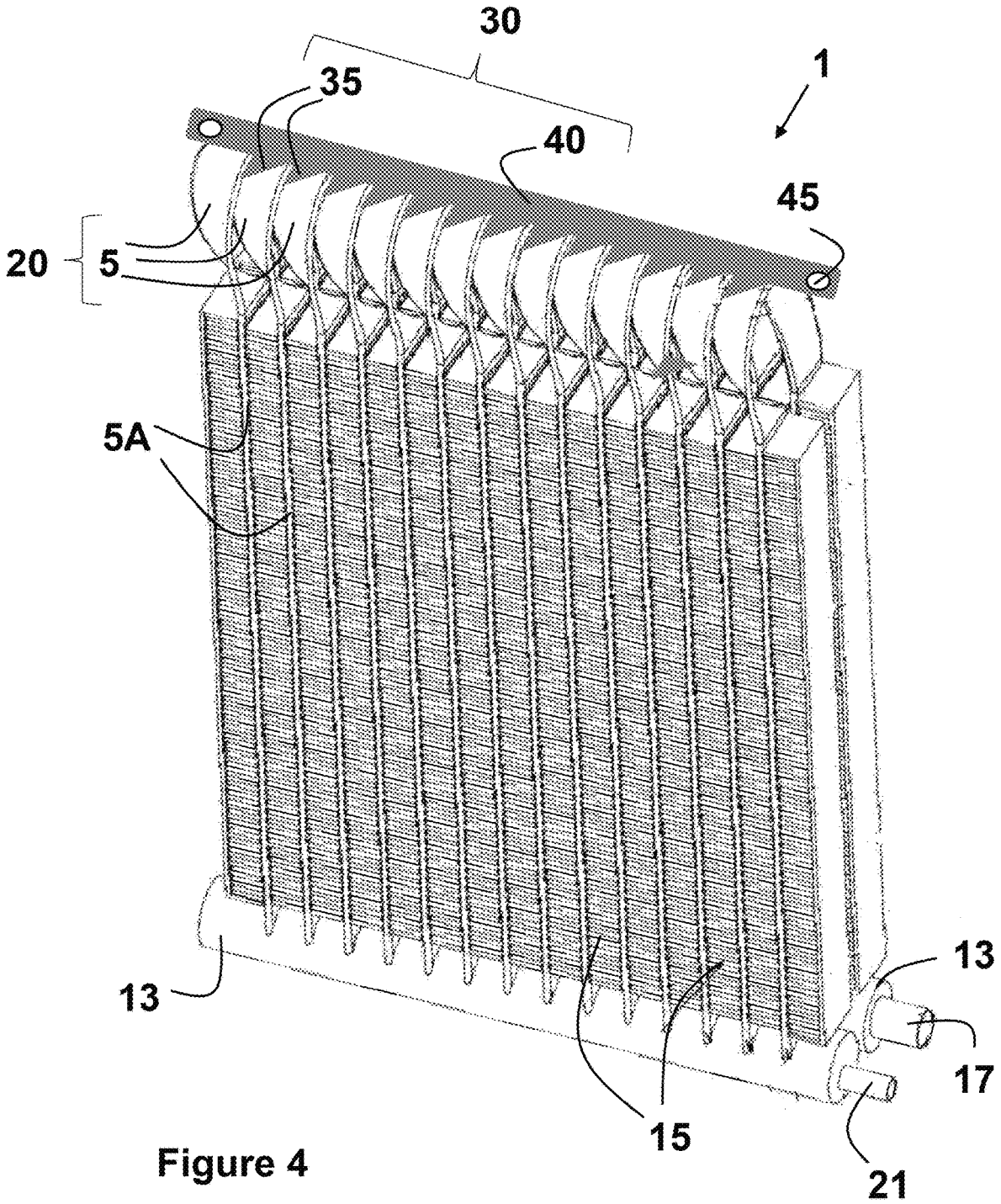
FIG. 4 is a schematic representation of a heat exchanger having the device of FIG. 2 incorporated therein as taught by present disclosure shown from a side view perspective.

According to another aspect of the present disclosure, a bent-tube heat exchanger is provided. Referring now to FIG. 4, this bent-tube heat exchanger 1 generally comprises a plurality of tubes 5 folded in a region 20 to form a coil-like configuration having a flattened cross-section along with multiple parallel flow channels 5A. This heat exchanger 1 includes a plurality of fins 15 that extend between the tubes 5. In addition, the heat exchanger 1 comprises one or more manifolds 13 that form an inlet 17 and outlet 21 for fluid flow within the heat exchanger 30. Each of the plurality of tubes 5 is in fluid communication with the one or more manifolds 13. A spacer device 30 as previously described above and further defined herein comprising a spine 40 and a plurality of fingers 35 is used to provide and maintain a separation between the tubes in the folded region.

When necessary or desirable one or more of the tubes 5 in the folded region may also be covered with a protective coating (not shown). Alternatively, at least one of the tubes 5 is coated in the folded region. This coating may be an organic coating that acts as a physical barrier between the metal of the tubes and the oxidizing elements in the environment. The coating may also be an inorganic material, such as without limitation a sacrificial material, e.g., a metal, which is applied or plated onto the tubes and preferentially corrodes before the tubes. The application of such a coating makes the tubes 5 in the folded region tougher and less susceptible to premature failure.

Figure 5:
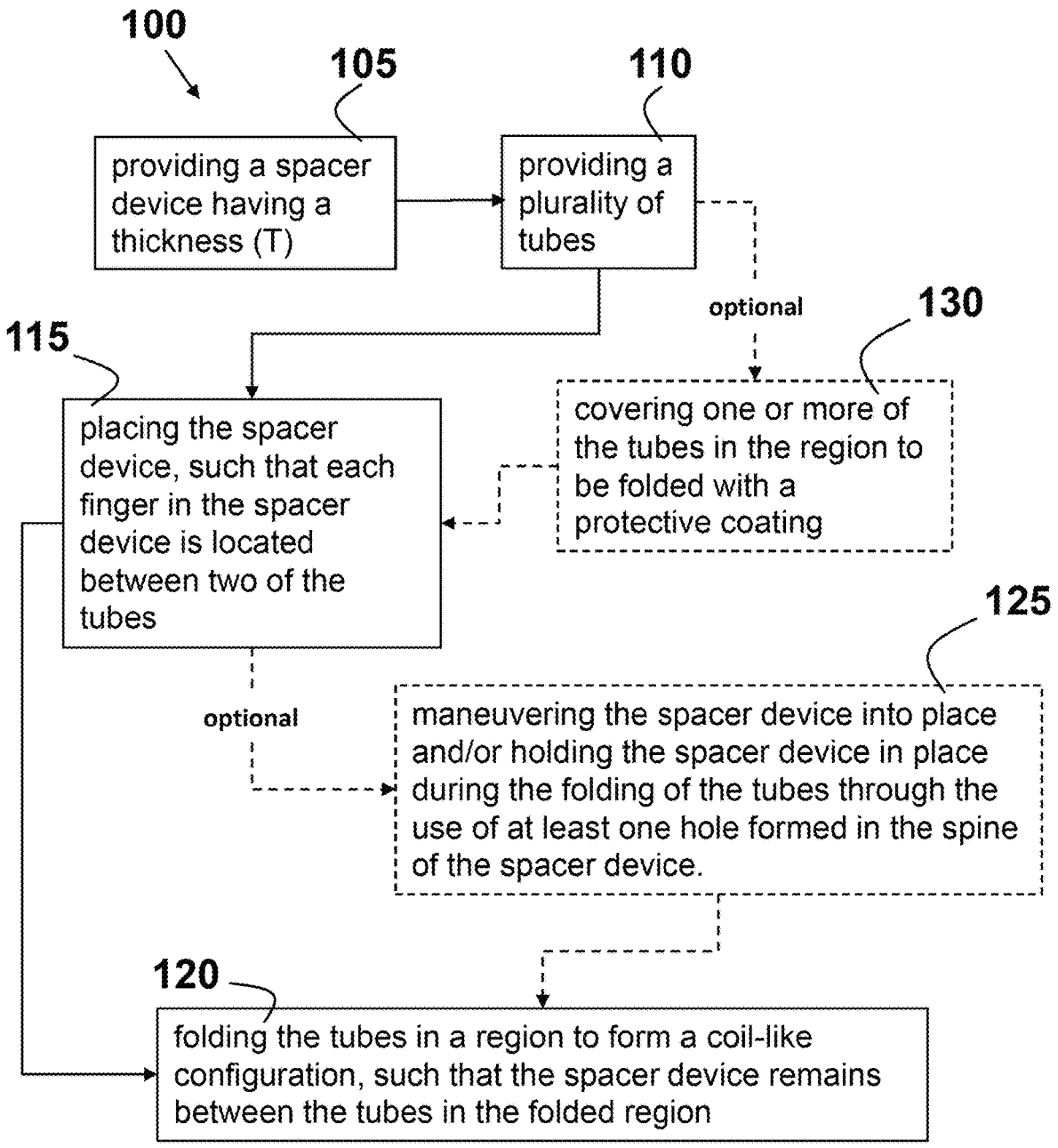
FIG. 5 is a flowchart illustrating a method for providing and maintaining separation between tubes during the formation of the bent-tube heat exchanger of FIG. 4.

According to yet another aspect of the present disclosure, a method for providing and maintaining separation between tubes during the formation of a bent-tube heat exchanger is provided. Referring now to FIG. 5, this method 100 comprises the steps of providing 105 a spacer device having a thickness (T) as previously described above and further defined herein; providing 110 a plurality of tubes; placing 115 the spacer device, such that each finger in the spacer device is located between two of the tubes; and folding 120 the tubes in a region to form a coil-like configuration, such that the spacer device remains between the tubes in the folded region. Optionally, the method 100 may further comprise the step maneuvering 125 the spacer device into place and/or holding the spacer device in place during the folding of the tubes through the use of at least one hole formed in the spine of the spacer device.

The thickness (T) of the spacer device represents the separation that is provided and maintained by the fingers between the tubes in the folded region. The fingers in the spacer device may be curved into a predetermined shape that provides an angle (α) with respect to the spine, such that the fingers are compatible with and assist in the folding of the tubes. The fingers of the spacer device lay on the tubes, thereby, exerting a force onto the tubes and providing the separation between the tubes.

When desirable, this method 100 may further comprise the step of covering 130 one or more of the tubes in the region to be folded with a protective coating that either provides a physical barrier between the tubes and the oxidizing elements in the environment or is a sacrificial material that preferentially corrodes before the tubes.

For the purpose of this disclosure the terms "about" and/or "substantial" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one manifold", "one or more manifolds", and "manifold(s)" may be used interchangeably and are intended to have the same meaning.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A bent-tube heat exchanger; the heat exchanger comprising:

a folded region consisting of a plurality of tubes folded in half that form bent tubes in a coil-like configuration having a flattened cross-section and at least one spacer device: wherein each tube forms two parallel flow channels with open ends that extend from the folded region through a core of the heat exchanger;

the core of the heat exchanger comprises the parallel flow channels and a plurality of fins that extend between the parallel flow channels in the core in order to provide for heat transfer; and one or more manifolds that form an inlet and outlet for fluid flow within the heat exchanger; each of the open ends of the parallel flow channels being in fluid communication with the one or more manifolds;

wherein the spacer device provides and maintains a separation between the bent tubes in the coil-like configuration of the folded region; the spacer device comprising:

a spine; and a plurality of fingers that protrude from one side of the spine, wherein the number of fingers is less than the number of bent tubes in the folded region, wherein a slot is located between the fingers that are adjacent to one another, the slot forming an L-shape or T-shape where the fingers protrude from the spine;

wherein the plurality of fingers are fit between the bent tubes in the coil-like configuration and held in place by exerting a force against the bent tubes;

wherein the spacer device is made of one or more soft plastic or hard rubber materials having a hardness in the range of about 5 to about 85 (Shore A durometer) or less than 45 (Shore D durometer).

2. The heat exchanger according to claim 1, wherein each of the plurality of fingers form an angle (α) with respect to the spine.

3. The heat exchanger according to claim 1, wherein the soft plastic or hard plastic material is polyurethanes, thermoplastic elastomers (TPEs), polyolefins, epoxies, fluoropolymers, silicones, polyamide, polycarbonate, polyesters, polyethylene, polyvinyl chloride, natural rubber (NR), styrene-butadiene rubber (SBR), ethylene propylene diene monomer rubber. (EPDM), nitrile butadiene rubber (NBR) and/or mixtures and combinations thereof.

4. The heat exchanger according to claim 1, wherein the spacer device further comprises one or more holes located in the spine.

5. The heat exchanger according to claim 4, wherein the one or more holes are circular, elliptical, triangular, square, and/or rectangular in shape.

6. The heat exchanger according to claim 1, wherein the spacer device has a thickness (T) that represents the separation that is provided and maintained by the fingers between the bent tubes in the coil-like configuration of the folded region.

7. The heat exchanger according to claim 1, wherein at least one of the bent tubes in the coil-like configuration of the folded region is covered with a protective coating that either provides a physical barrier between the tubes and any oxidizing elements in the environment or is a sacrificial material that preferentially corrodes before the tubes.

8. The heat exchanger according to claim 1, wherein the spacer device assists in the drainage of condensate from the tubes and fins in the core of the heat exchanger when the heat exchanger is installed with the fold region being the core.

9. A method for providing and maintaining separation between tubes during the formation of a bent-tube heat exchanger according to claim 1, wherein the method comprises steps performed in the following order of:

providing the at least one spacer device providing the plurality of tubes;

placing the at least one spacer device, such that each finger in the spacer device is located between two of the tubes;

folding the tubes in half to form the bent tubes in the coil-like configuration in the folded region of the bent-tube heat exchanger, such that the spacer device remains between the bent tubes in the coil-like configuration;

providing the plurality of fins that extend between the parallel flow channels established by the tubes in the core; and connecting the open ends of each tube to the one or more manifolds, thereby forming the bent-tube heat exchanger;

wherein the thickness (T) of the spacer device represents the separation that is provided and maintained by the fingers between the bent tubes in the coil-like configuration in the folded region.

10. The method according to claim 9, wherein the method further comprises a step of covering one or more of the tubes in the folded region with a protective coating that either provides a physical barrier between the tubes and the oxidizing elements in the environment or is a sacrificial material that preferentially corrodes before the tubes.

11. The method according to claim 9, wherein the spacer device includes fingers that are curved into a predetermined shape that provides an angle ($\alpha$) with respect to the spine, such that the fingers with the L-shaped or T-shaped slot are compatible with and assist in the folding of the tubes.

12. The method according to claim 9, wherein the fingers of the spacer device lay on the tubes, thereby, exerting a force onto the tubes and providing the separation between the tubes.

13. The method according to claim 9, wherein the method further comprises forming at least one hole in the spine of the spacer device, maneuvering the spacer device into place and/or holding the spacer device in place during the folding of the tubes through the use of the at least one hole formed in the spine of the spacer device.

* * * * *